United States Patent [19]

Wieringa

[11] Patent Number: 4,941,493

[45] Date of Patent: Jul. 17, 1990

[54] DEVICE FOR WASHING AND DRYING THE INSIDE TANK OF A TANKER TRUCK

[75] Inventor: Tom Wieringa, Oakbrook, Ill.

[73] Assignee: Carry Companies of Illinois, Bridgeview, Ill.

[21] Appl. No.: 232,661

[22] Filed: Aug. 15, 1988

[51] Int. Cl.[5] ..... B08B 3/02

[52] U.S. Cl. ..... 134/166 R; 134/169 R; 134/182; 134/99

[58] Field of Search ..... 134/166 R, 169 R, 182, 134/183, 200, 99; 239/214.11, 214.19, 222.11, 223, 224

[56] References Cited

U.S. PATENT DOCUMENTS

| | | | |
|---|---|---|---|
| 383,964 | 6/1888 | Mackintosh | 134/167 R X |
| 1,838,634 | 12/1931 | Peterson et al. | 134/167 R |
| 1,857,766 | 5/1932 | Peterson et al. | 134/167 R X |
| 2,116,935 | 5/1938 | Richard et al. | 134/167 R |
| 2,845,934 | 8/1958 | Payson | 134/169 R X |
| 3,046,163 | 7/1962 | Kearney et al. | 134/103 X |
| 4,039,351 | 8/1977 | Butler | 134/167 R X |
| 4,144,901 | 3/1979 | Stevenson | 134/166 R X |

OTHER PUBLICATIONS

Gateway Builds New Food-Grade Tank Wash, Modern Bulk Transporter, Mar. 1988.

*Primary Examiner*—Frankie L. Stinson
*Attorney, Agent, or Firm*—Willian Brinks Olds Hofer Gilson & Lione

[57] ABSTRACT

A device for washing and drying the inside tank portion of a tanker truck. The device is adaptable for fitting into a manway located in the tank and comprises a cone-shaped base which fits into a plugs the manway. A washing medium tube passes through the base in an axial direction and extends above and below the base. A drying medium tube also passes through the base in an axial direction and extends above the top of the base and terminates near the bottom of the base. A cone-shaped deflector is located below the bottom of the base and deflects drying medium throughout the entire inside portion of the tank. The device further comprises vent tubes which pass through the base in an axial direction and provides sufficient ventilation of the tank while maintaining a pressure greater than atmospheric in the tank. The positive pressure in the tank allows hoses connected to the tank to be cleaned and dried in an efficient manner.

6 Claims, 1 Drawing Sheet

FIG. 1
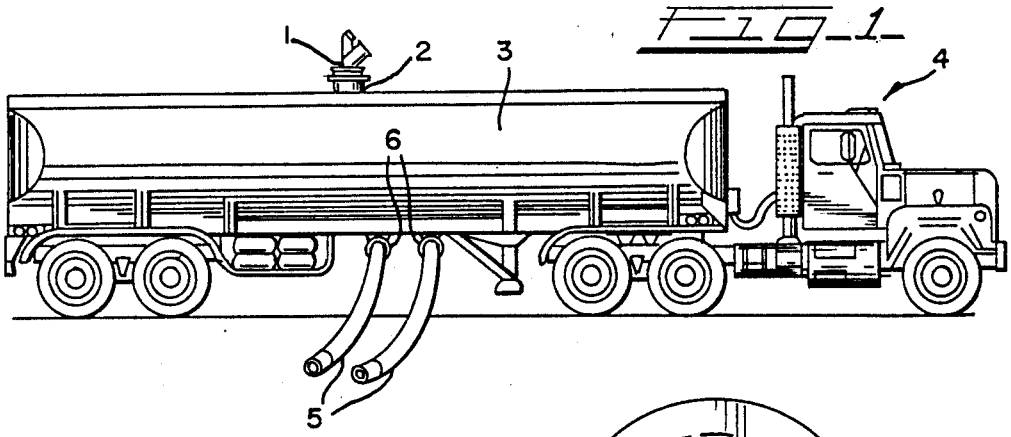
FIG. 2
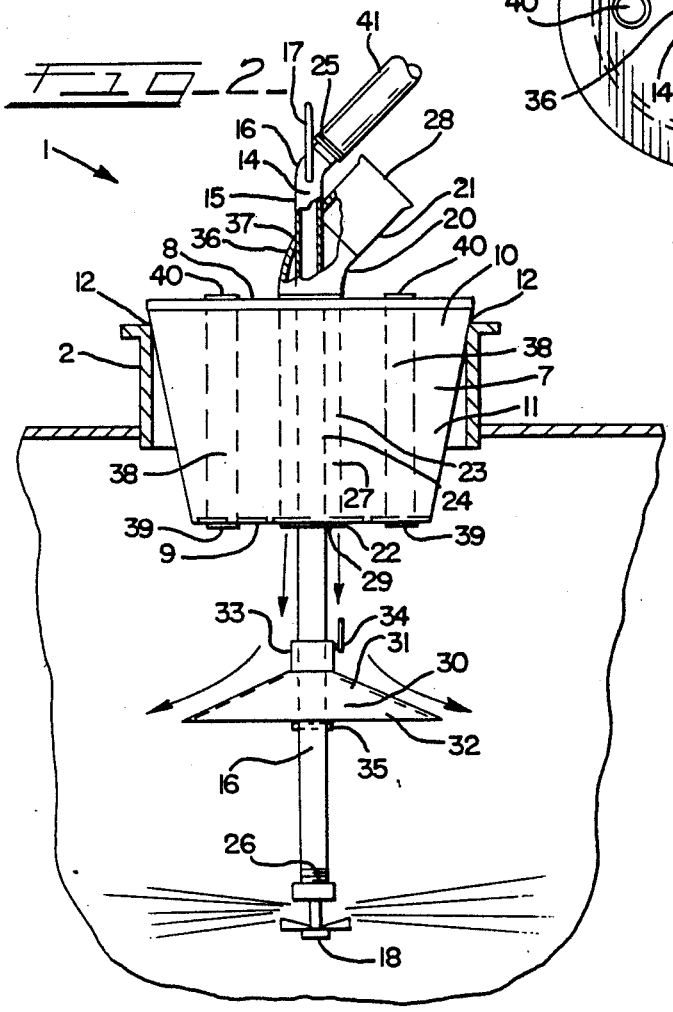
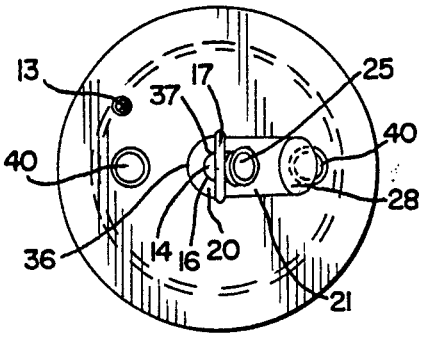
FIG. 3

DEVICE FOR WASHING AND DRYING THE INSIDE TANK OF A TANKER TRUCK

BACKGROUND OF THE INVENTION

This invention relates to cleaning the inside tank portion of a tanker truck and the inside portion of any hoses connected to the tank.

Tanker trucks are often used to carry food grade liquids such as corn syrup. Suppliers and end users have certain specifications such as solids content, impurity content, etc. for these products. In addition, a tanker truck will not always carry the same food grade liquid. Accordingly, the inside tanks are periodically cleaned.

Tank trucks are generally cleaned by introducing a hot wash solution into the tank and then allowing the tank to cool and dry. The wash solution is usually pumped out through hoses connected to the tank. The tank is cooled and dried by exposure to the atmosphere, usually through a manway.

These tank washing procedures produce many problems. For example, it is difficult to know whether the tank was exposed to a wash solution of sufficient temperature and for a sufficient time to ensure sterilization. Even if the tank is sufficiently sterile, the presence of steam in the tank prevent its inspection while hot.

Cooling of the tank causes further problems. To prevent the formation of a vacuum, the tank is cooled and dried by exposure to the atmosphere. This is often done by leaving the tank manway open. However, ambient cooling allows contaminants into the tank. In addition, ambient cooling wastes time better spent on transporting pay loads.

One solution to the cooling problem is to load the trucks immediately after cleaning. However, this causes the introduction of unwanted water into the payload. Further, if the truck has to travel any distance to the loading point, the steam in the tank and hoses often condenses. This presents further problems in cold weather where the condensate freezes.

There is therefore a long felt need for a device which will clean, sterilize and dry the inside tank portion of a tanker truck. The device would preferably automatically wash and dry the tank without the waste of time and materials. More preferably, the device would easily be inserted inside the tank and after washing, sterilizing and drying easily be removed. The tanker would then be ready for transporting bulk food or pharmaceutical grade liquid loads.

There is further a need for quickly washing, sterilizing and drying not only the inside portion of the tank but also any hoses connected to the tank. A device capable of washing both the inside portion of a tank and the inside portion of hoses attached to the tank would be widely accepted in the industry and meet with commercial success.

It is therefore an object of the present invention to provide a device for washing and drying the inside tank of a tanker truck. It is another object of the present invention to provide a device for washing and drying the inside portion of a tanker trunk and the inside portion of hoses connected to the tank. It is further an object of the present invention to provide a device which after washing and sterilizing, dries the inside of tanks and hoses connected thereto much more efficiently and effectively than ambient drying. It is still a further object of the present invention to provide a tank washing and drying device which allows the tank to be sealed from contamination after drying without the risk of creating a vacuum in the tank.

These and other objectives which will become apparent in view of the specification are satisfied by the present invention. It is to be understood however that the present invention is not limited to its objectives, the spirit and scope of the invention being delineated in the appended claims.

SUMMARY OF THE INVENTION

In one embodiment the present invention provides a device for washing and drying the inside tank portion of a tanker truck. The device comprises a cone shaped base comprising an upper portion and a lower portion. The upper portion has a top while the lower portion has a bottom. The diameter of the upper portion is larger than the diameter of the lower portion to form a tapered concentric exterior surface. The device further comprises means for introducing and distributing a washing medium through the base and into the tank. The device also comprises means for introducing and distributing a drying medium through the base and into the tank.

In accordance with another embodiment the present invention provides a device for washing and drying the inside tank portion of a tanker truck. The device is adaptable for fitting into and sealing different size manways located in the tank. The device comprises a cone-shaped base comprising an upper portion having a top and a lower portion having a bottom. The diameter of the lower portion is sufficiently small to allow the lower portion of the base to pass through the manway. The diameter of the upper portion is sufficiently large to prevent the upper portion of the base from passing through the manway. A washing medium tube having an inlet and an outlet passes through the base in an axial direction. The inlet of the washing medium tube extends above the top of the base while the outlet extends below the bottom of the base. A drying medium tube having an inlet and an outlet also passes through the base in an axial direction. The inlet of the drying medium tube extends above the top of the base while the outlet terminates near the bottom of the base. A cone-shaped deflector is located below the bottom of the base and has its center on the longitudinal axis of the drying medium tube. The deflector has an upper portion and a lower portion and the diameter of the upper portion is less than the diameter of the lower portion. The device further comprises at least one vent tube having an inlet and an outlet which passes through the base in an axial direction. The inlet of the vent tube(s) terminates near the bottom of the base while the outlets terminate near the top of the base.

In accordance with a preferred embodiment the axis of a portion of the washing medium tube and the axis of a portion of the drying medium tube are on the same line. The diameter of the drying medium tube portion is larger than the diameter of the washing medium tube portion thereby forming an annulus about the washing medium tube portion to provide a drying medium passageway.

In accordance with another preferred embodiment, the upper portion of the cone-shaped deflector is slidably affixed to the washing medium tube below the bottom of the base to secure the deflector and provide adjustment of the deflection pattern of the drying medium.

In accordance with yet another preferred embodiment, the diameter of the vent tube(s) is sufficiently large to allow ventilation of the tank but sufficiently small to maintain a pressure greater than atmospheric in the tank.

In still a further embodiment the present invention provides a method for cleaning the inside tank portion of a tanker truck having a manway. The method comprises fitting a cone-shaped plug into the manway and washing and rinsing the inside portion of the tank by introducing a washing medium followed by a rinsing medium and respectively distributing each throughout the tank. The tank is then dried by introducing a drying medium and distributing it throughout while maintaining a positive pressure in the tank. The inside portions of hoses connected to the tank may also be cleaned by the washing medium, rinsing medium and drying medium as they respectively exit the tank through the connected hoses. In a preferred embodiment the washing, rinsing and drying medium are introduced into the tank through the plug.

BRIEF DESCRIPTION OF THE DRAWINGS

FIG. 1 provides a view of the device of the present invention inserted in the manway of the tank of a tanker truck.

FIG. 2 is a side view of one embodiment of the device of the present invention.

FIG. 3 is a top view of one embodiment of the device of the present invention.

DETAILED DESCRIPTION OF PREFERRED EMBODIMENTS

FIG. 1 illustrates a washing and drying device 1 inserted into manway 2 of tank 3 of tanker truck 4. Hoses 5 are connected to the lower portion 6 of tanker truck 4.

Referring to FIGS. 2 and 3 device 1 comprises a cone-shaped base 7 having top 8 and bottom 9. The cone-shaped base is constructed to have an upper portion 10 and a lower portion 11. The diameter of the upper portion is greater than the diameter of the lower portion. Thus, base 7 is tapered and fits into and plugs manway 2. Preferably, base 7 has a tapered concentric exterior to provide a good seal with manway gasket 12.

Base 7, top 8 and bottom 9 are preferably constructed of a strong but inexpensive metallurgical material. Base 7 and/or top 8 and bottom 9 however may also be constructed of any material such as a strong resilient resinous material which can withstand sterilization conditions and is acceptable for the handling of food grade quality materials. Base 7, top 8, and bottom 9 are also preferably constructed to have an inside hollow portion, access to which can be gained through plug and coupling assembly 13 in top 8 (see FIG. 3).

Washing medium tube 14 having an inlet portion 15 and an outlet portion 16 passes through the cone in an axial direction and through top 8 and bottom 9. In this preferred embodiment, inlet portion 15 of washing medium tube 14 is bent to form an elbow 16 near inlet 25 to provide for handle 17 which allows the device to be swung into position and inserted into manway 2 with the assistance of a pulley system (not shown). A washing distributor 18 which can be any common device known in the art is fitted at outlet 26 below bottom 9 of base 7.

Drying medium tube 20 having inlet portion 21 and inlet 28 above top portion 8 and outlet portion 22 and outlet 29 terminating at bottom portion 9 also passes through base 7 in an axial direction. A portion 23 of drying medium tube 20 and a portion 24 of washing medium tube 14 are arranged so that their axes are on the same line. The diameter of drying medium tube portion 23 is larger than the diameter of washing medium tube portion 24 to form an annulus about washing medium tube portion 24 to provide a drying medium passageway 27. The inlet portion 21 of drying medium tube 20 is also bent to form an elbow 36. Inlet portion 15 of washing medium tube 14 passes through elbow 36 at aperture 37 which is appropriately sealed to prevent the drying medium passing through drying medium tube 20 from escaping.

Deflector 30 located below bottom 9 of base 7 has its center on the longitudinal axis line of drying medium tube portion 23. Deflector 30 is cone-shaped and has an upper portion 31 and a lower portion 32. The diameter of upper portion 31 is less than the diameter of lower portion 32 thereby forming a concentric sloped surface which deflects drying medium introduced through drying medium tube 20 into the inside portion of the tank as indicated by the arrows (see FIG. 2). A top portion 33 extending from the upper portion 31 of deflector 30 is slidably affixed to washing medium tube 14 by bolt assembly 34. Thus, deflector 30 may be moved up and down outlet portion 16 of washing medium tube 14 to vary the deflection pattern of the drying medium exiting drying medium tube outlet 29. Collar 35 located below bolt assembly 34 prevents deflector 30 from sliding down lower outlet portion 16 of washing medium tube 14 and damaging washing distributor 18.

Washing medium tube 14, drying medium tube 20, and deflector 30 are also preferably constructed of a strong but inexpensive metallurgical material. They however may be constructed of any material such as a strong resilient resinous material which can withstand the cleaning and sterilization conditions, pressures of the fluid materials passing through and contacting them, and the temperatures experienced during the entire cleaning and drying process. These components of course must also be acceptable for the handling of food grade quality materials.

While not presently illustrated it is further contemplated that more than one washing and drying medium tubes are present. Further, the washing and drying medium tubes may be construed to branch out radially and terminate near the radial exterior of the base. In this case, appropriate radial deflectors may also be employed.

Vent tubes 38 also pass through base 7 in an axial direction. Vent tubes 38 terminate at one end at bottom 9 forming inlet 39 and at the other end at top 8 forming outlet 40. The diameter of vent tubes 38 is sufficiently large to allow ventilation from the tank but sufficiently small to maintain a pressure greater than atmospheric (i.e. positive pressure) in the tank throughout the drying phase of the cleaning process. Vent tubes 38 are also preferably constructed of a strong but inexpensive metallurgical material but may also be constructed of any material which can withstand the cleaning process conditions and is acceptable for the handling of food grade quality materials.

In operation, the cone-shaped base 7 is inserted into and plugs manway 2. The distal ends of any hoses 5 connected to tank 3 are opened. A pump (not shown) may be attached to tank 3 or to the distal ends of one or a plurality of hoses 5.

Any washing and drying cycle may be employed to clean the inside tank portion and inside portion of any hoses attached. Thus the washing and drying cycles may be conducted manually or by a computer aided program. The washing and rinsing mediums pass through washing medium tube 14 and are fed from exterior tanks (not shown) through line 41 connected to washing medium tube inlet 25 (see FIG. 2).

Preferably, a three step washing cycle is employed. First a residue wash is effected by a burst rinse. After the burst rinse a main wash is introduced and distributed throughout the inside tank portion. The washing solution comprises water which may contain a plurality of known additives including soap, sanitizers, phosphoric acid, etc. After the main wash, a sterilizing wash is conducted at a temperature greater than about 180° F. for a time of at least about 15 minutes. The rinse, wash and sterilization solutions are recommended either directly from the tank or after passing through hoses connected to the tank. In the latter case, the inside portions of the hoses are cleaned. After washing the tank and any connected hoses are dried.

The inside tank portion is dried with a drying medium which is fed to drying medium tube 20 through inlet 28. The drying medium is preferably provided by a 15 horsepower centrifugal blower (not shown) containing a 150 micron filter. Ambient air is fed to the centrifugal blower and heated to about 135° F. and then passed through an ultraviolet sterilizer. The air is then directed to and passes through drying medium tube 20 and impinges upon deflector 30. As the arrows in FIG. 2 indicate, deflector 30 distributes the drying medium throughout the entire inside portion of the tank. Deflector 30 also prevents any washing, rinsing or sterilizing medium from spraying up through vents 38.

Vents 38 have a diameter sufficiently large to provide ventilation of the tank but sufficiently small to maintain a positive pressure in the tank. It is important that all portions including the top inside portion of tank 3 be exposed to the washing, sterilizing and drying mediums. Thus vents 38 provide sufficient ventilation to create upward currents in tank 3 allowing complete distribution of the drying medium to areas of the tank. The diameter of vent 38 however is sufficiently small enough to maintain a pressure greater than atmospheric in the tank. This positive pressure allows the hot drying medium to be forced into any hoses connected to the tank and out their distal ends thereby drying the inside portions of the hoses.

After drying, the device is removed from the manway and the tank sealed. Since the tank is completely dry and near ambient temperature, no condensation will occur and no vacuum will form in the sealed tank. Further, the sealed tank ensures that contaminants will be kept out.

It is to be understood that the present invention is not limited to the embodiments illustrated and discussed above. Accordingly, all equivalents are contemplated by the present invention, the scope of which is delineated in the appended claims.

I claim:

1. A device for washing and drying the inside tank portion of a tanker truck, said device being adaptable for fitting into a manway located in the tank, said device comprising:

a cone-shaped base comprising an upper portion having a top and a lower portion having a bottom, the diameter of the lower portion being sufficiently small to allow said lower portion to pass through the manway and the diameter of the upper portion being sufficiently large to prevent said upper portion from passing through said manway;

a washing medium tube having an inlet and an outlet, said washing medium tube passing through said base in an axial direction, said inlet extending above the top of said base and said outlet extending below the bottom of said base;

a drying medium tube having an inlet and an outlet, said drying medium tube passing through said base in an axial direction, said inlet extending above the top of said base and said outlet terminating near the bottom of said base;

the longitudinal axis of a portion of the washing medium tube and the longitudinal axis of a portion of the drying medium tube are on the same line and the diameter of said drying medium tube portion is larger than the diameter of said washing medium tube portion thereby forming an annulus about said washing medium tube portion to provide a drying medium passageway;

a cone-shaped deflector located below the bottom of said base and having its center on the axis of said drying medium tube, said deflector having an upper portion and a lower portion, the diameter of the upper portion being less than the diameter of the lower portion; and at least one vent tube having an inlet and an outlet, said vent tube passing through said base in an axial direction, said inlet terminating near the bottom of said base and said outlet terminating near the top of said base.

2. The device of claim 1 wherein the diameter of said vent tube is sufficiently large to allow ventilation of said tank but sufficiently small to maintain a pressure greater than atmospheric in the tank.

3. The device of claim 1 comprising two vent tubes.

4. The device of claim 1 further comprising a wash distributor means at the outlet end of said washing medium tube.

5. The device of claim 1 wherein the base is hollow.

6. A device for washing and drying the inside tank of a tanker truck, said device being adaptable for fitting into a manway located in the tank, said device comprising:

a cone-shaped base comprising an upper portion having a top and a lower portion having a bottom, the diameter of the lower portion being sufficiently small to allow said lower portion to pass through the manway and the diameter of the upper portion being sufficiently large to prevent said upper portion from passing through said manway;

a washing medium tube having an inlet and an outlet, said washing medium tube passing through said base in an axial direction, said inlet extending above the top of said base and said outlet extending below the bottom of said base;

a drying medium tube having an inlet and an outlet, said drying medium tube passing through said base in an axial direction, said inlet extending above the top of said base and said outlet terminating near the bottom of said base;

the longitudinal axis of a portion of the washing medium tube and the longitudinal axis of a portion of the drying medium tube being on the same line, the diameter of said drying medium tube portion being larger than the diameter of said washing medium tube portion thereby forming an annulus about said washing medium tube portion to provide a drying medium passageway;

a cone-shaped deflector located below the bottom of said base and having its center on the axis line of said drying medium tube portion and said washing medium tube portion, said deflector having an upper portion and a lower portion said upper portion being slidably affixed to said washing medium tube below the bottom of said base, the diameter of the upper portion being less than the diameter of the lower portion; and a plurality of vent tubes each having an inlet and an outlet, said vent tubes passing through said base in an axial direction, said inlets terminating near the bottom of said base and said outlets terminating near the top of said base, the diameter of said vent tubes being sufficiently large to allow ventilation from the tank but sufficiently small to maintain a pressure greater than atmospheric in the tank.

* * * * *

UNITED STATES PATENT AND TRADEMARK OFFICE

CERTIFICATE OF CORRECTION

PATENT NO. : 4,941,493

DATED : July 17, 1990

INVENTOR(S) : Tom Wieringa

It is certified that error appears in the above-identified patent and that said Letters Patent is hereby corrected as shown below:

IN THE ABSTRACT

On the cover page, line 4 of the Abstract, after "into" please delete "a" and substitute therefor --and--.

In column 1, line 26, please delete "prevent" and substitute therefor --prevents--.

In column 1, line 33, please delete "pay loads" and substitute therefor --payloads--.

In column 1, line 61, please delete "trunk" and substitute therefor --truck--.

In column 2, line 13, please delete "cone shaped" and substitute therefor --cone-shaped--.

UNITED STATES PATENT AND TRADEMARK OFFICE

CERTIFICATE OF CORRECTION

PATENT NO. : 4,941,493

DATED : July 17, 1990

INVENTOR(S) : Tom Wieringa

It is certified that error appears in the above-identified patent and that said Letters Patent is hereby corrected as shown below:

In column 5, line 22, please delete "and".

Signed and Sealed this

Eighteenth Day of August, 1992

*Attest:*

DOUGLAS B. COMER

*Attesting Officer*

*Acting Commissioner of Patents and Trademarks*